United States Patent [19]

Perotto et al.

[11] Patent Number: 4,657,607

[45] Date of Patent: Apr. 14, 1987

[54] PROCESS FOR THE SOLVENT-FREE MANUFACTURE OF COMPOUND PYROTECHNIC PRODUCTS CONTAINING A THERMOSETTING BINDER AND PRODUCTS THUS OBTAINED

[75] Inventors: Christian Perotto, Ballancourt; Philippe Ragon, Ris Orangis, both of France

[73] Assignee: Societe Nationale des Poudres et Explosifs, Paris, France

[21] Appl. No.: 833,142

[22] Filed: Feb. 26, 1986

[30] Foreign Application Priority Data

Feb. 27, 1985 [FR] France ..... 85 02796

[51] Int. Cl.[4] ..... C06B 45/10

[52] U.S. Cl. ..... 149/19.4; 149/60; 149/61; 149/76; 149/83; 149/88; 149/92; 149/93; 149/109.6; 264/3.3

[58] Field of Search ..... 149/19.4, 60, 61, 76, 149/83, 88, 92, 93, 109.6; 264/3 B

[56] References Cited

U.S. PATENT DOCUMENTS

| | | | |
|---|---|---|---|
| 4,110,135 | 8/1978 | Graham et al. | 149/19.4 |
| 4,184,031 | 1/1980 | Graham et al. | 149/19.4 |
| 4,196,129 | 4/1980 | Rhein et al. | 149/19.4 |
| 4,234,364 | 11/1980 | Robinson, Jr. | 149/19.4 |
| 4,267,132 | 5/1981 | Henderson et al. | 264/3 B |
| 4,456,493 | 6/1984 | Barnes et al. | 149/19.4 |
| 4,555,277 | 11/1985 | Scribner | 149/92 |

FOREIGN PATENT DOCUMENTS 2225979 10/1979 France .

2073764 10/1981 United Kingdom .

OTHER PUBLICATIONS

Rapport de Recherches (French Search Report) of Oct. 31, 1985.

*Primary Examiner*—Stephen J. Lechert, Jr.

*Attorney, Agent, or Firm*—Burns, Doane, Swecker & Mathis

[57] ABSTRACT

The present invention relates to the field of compound pyrotechnic products.

The invention relates to a three-step, solvent-free process for the manufacture of compound pyrotechnic products containing a thermosetting binder obtained by reaction of a polyhydroxylated prepolymer with a diisocyanate, which process is characterized in that:

- in a first step the said prepolymer is mixed with an energetic charge and with a quantity of diisocyanate representing 50 to 90% of the required stoichiometric quantity,
- in a second step the remainder required to attain the said stoichiometric quantity is added and, after mixing, the pasty mixture thus obtained is extruded,
- in a third step the crosslinking of the thermosetting binder is completed hot.

The invention makes it possible to obtain industrially, by extrusion, small-diameter pyrotechnic products containing a thermosetting binder without restriction on the "pot life" period. The invention is particularly suitable for the production of compound propellent powders for arms.

16 Claims, No Drawings

PROCESS FOR THE SOLVENT-FREE MANUFACTURE OF COMPOUND PYROTECHNIC PRODUCTS CONTAINING A THERMOSETTING BINDER AND PRODUCTS THUS OBTAINED

The present invention relates to the field of compound pyrotechnic products and especially to propellent powders for arms and to processes for manufacturing them. More precisely, the invention relates to a new process for the solvent-free manufacture of compound pyrotechnic products containing a thermosetting binder, that is to say pyrotechnic products consisting essentially of a thermosetting inert binder and at least one pulverulent oxidizing charge. The invention also relates to the pyrotechnic products, especially propellent powders, obtained by virtue of the process according to the invention.

So-called "homogeneous" propellent powders are known, which consist of one or more gelatinized energetic bases which are homogeneous in appearance when viewed in cross-section, which accounts for their name. Among the best-known homogeneous propellent powders mention can be made of the "smokeless" powders based on nitrocellulose by itself or based on a nitrocellulose-nitroglycerine mixture. To improve the ballistic performance of these powders attempts have been made to include pulverulent inorganic or organic oxidizing charges therein. Seen in cross-section, these powders are no longer homogeneous in appearance, but present a heterogeneous appearance in which the energetic binder, on the one hand, and the oxidizing charge, on the other hand, can be distinguished, and they are known as "compound" or "heterogeneous" powders.

Such powders are described, for example, in French Patent No. 2,488,246.

However, the use of energetic binders such as, for example, nitrocellulose has the disadvantage of making the powders sensitive. Sensitivity is understood to mean the fact that these powders can ignite and deflagrate under the effect of an undesired random physical phenomenon such as, for example, the impact of a projectile. Sensitivity is a major drawback in the case of powders intended to be carried aboard ships, aircraft or tanks. Consequently, the development of modern combat equipment leads the specialist to investigate propellent powders of low sensitivity.

Compound powders containing an inert binder and consisting chiefly of a synthetic resin and an inorganic or organic oxidizing charge have been found to be markedly less sensitive than homogeneous or compound powders containing an energetic binder. However, since they contain an inert binder, these powders must contain very high proportions of charges, frequently close to 80% of the total weight of the powder, in order to have the necessary energy when ignited. Compared to other compound materials, compound powders containing an inert binder thus have the characteristic of actually containing very little binder relative to pulverulent charge. Nevertheless, these powders need to be capable of being fabricated under fairly demanding conditions, in particular they must be capable of being extruded through a die of a relatively small diameter, comprising, in most cases, inserts intended to produce the channels present in the powder rod and of then retaining their geometrical shape with time. It is precisely in connection with the use of compound propellent powders containing an inert binder for arms that the specialist has met with numerous difficulties.

The inert binders of synthetic origin which can be used in compound pyrotechnic products can be categorized, as any resin, into thermoplastic binders and thermosetting binders. Naturally, the use of thermoplastic binders was the first to be considered by the specialist, since these binders permitted mechanical and thermal processing of the product to give it the required geometry.

European Patent Application No. 0,036,481 thus describes a process for the manufacture of compound explosives containing a thermoplastic binder. Nevertheless, the compound products containing a thermoplastic binder which are described in this patent are not entirely satisfactory insofar as their geometry is too sensitive to temperature variations.

The specialist then turned to the use of thermo-setting inert binders such as three-dimensional polyester or polyurethane binders which make it possible, after the resin has completely polymerized, to fix the geometry of the powder particle in a definitive manner. The manufacture of such powders on an industrial scale, however, is very difficult because, on the one hand, thermosetting resins have a limited "pot life" ("pot life" means the period during the polymerization of the resin during which the latter can be fabricated like a plastic) and, on the other hand, because, as a result of the high proportion of charge in the compound powders, the binder must already have good mechanical behavior at the time of extrusion, to ensure the cohesion of the propellent paste.

To overcome these disadvantages within the scope of the use of thermosetting binders, the specialist has attempted to work in the presence of solvents, as described, for example, in French Patent Nos. 2,268,770 and 2,488,246. However, these methods are complex and costly in use, which is unsatisfactory on an industrial scale.

In order to use thermosetting binders without using a solvent, the specialist has, to a large extent, employed a technique known as the "casting" or "global" technique, which consists in simultaneously mixing in a kneader the elementary liquid constituents of the resin and of the oxidizing charge and in casting, before polymerization, the mixture thus obtained in a mould in order to conduct the polymerization as such therein. This technique, which has been extensively described, for example in French Patent Nos. 2,109,102, 2,196,998, 2,478,623 and 2,491,455, can be suitable for the manufacture of compound solid propellants for rocket motors or rockets, or for the manufacture of compound explosives for the heads of weapons which are in most cases used in the form of products with a large diameter, but is found to be poorly suited to the industrial manufacture of coarse compound powders and completely unsuitable for the industrial manufacture of small-diameter compound powders and, more generally, of small-diameter compound pyrotechnic products.

The only solution available to the specialist at the present time for solvent-free manufacture of small-diameter compound pyrotechnic products, containing a thermosetting inert binder, is that which consists in mixing the constituents of the resin with the oxidizing charge in a kneader, in initiating the polymerization of the resin and, during the polymerization, in carrying out, over a very short time interval, the extrusion of the product as described, for example, in French Patent Nos. 1,409,203 and 2,159,826. This technique, which does not allow large quantities of product to be manufactured simultaneously, is unsatisfactory on an industrial scale and, furthermore, can be used in practice only for large-diameter extrusions.

The specialist is consequently searching for an industrial process for solvent-free manufacture of small-diameter compound pyrotechnic products containing a thermo-setting inert binder.

The aim of the present invention is precisely to provide such a process.

The invention consequently relates to a process for the manufacture of compound pyrotechnic products, and especially compound propellent powders consisting chiefly, on the one hand, of a polyurethane binder obtained by reaction of a polyhydroxylated prepolymer with a diisocyanate and, on the other hand, of at least one inorganic or organic energetic charge, characterized in that the said polyhydroxylated prepolymer has a number average moleculare mass of between 2,000 and 5,000 and an average hydroxyl group OH functionality greater than 2 and less than 3, and in that:

in a first step, the said polyhydroxylated prepolymer is mixed with the said energetic charge and with a quantity of diisocyanate which is between 50% and 90% by weight of the stoichiometric quantity required for the complete polymerization of all the hydroxyl OH groups in the said prepolymer, and the condensation reaction of the isocyanate NCO groups with the hydroxyl OH groups is carried out so as to produce a partially polymerized paste, in a second step the partially polymerized paste thus obtained is mixed with the remainder of the diisocyanate required to attain the said stoichiometric quantity which is necessary for complete polymerization and the pasty mixture thus obtained is extruded, in a third step, the condensation reaction of the isocyanate NCO groups, added during the second step, with the hydroxyl OH groups which are still free is completed by a hot cure.

The invention also relates to compound pyrotechnic products such as propellent powders for arms, propellants, and explosives obtained by the process according to the invention. In particular, the invention relates to the powders in which the binder is obtained by reaction of a hydroxytelechelic polybutadiene having an average hydroxyl OH group functionality close to 2.3 with a diisocyanate and in which the energetic charge consists of hexogen.

The invention thus enables the specialist to have available an industrial process for solvent-free manufacture of compound pyrotechnic products, and especially compound propellent powders, containing a thermosetting inert binder. The choice of the functionality of the polyhydroxylated prepolymer, in fact, imparts the thermosetting character to the resulting polyurethane. The particular method of operation reserved within the scope of the invention makes it possible, at the end of the first step, to have a partially polymerized paste which has certain plastic properties at this stage, which make it extrudable, including small-diameter extrusion, especially after the addition of the residual quantity of diisocyanate. The Applicant Company has found, in fact, that the pasty mixture obtained at the end of the second stage is pseudo-unreactive at ambient temperature or a temperature slightly higher than ambient temperature, and can be fabricated without precipitation and without the risk of setting solid irreversibly. It is only as a result of the hot cure provided in the third step that the extruded product is set in its chemical structure. The process according to the invention, which makes it possible to prepare, without solvent, large quantities of a paste which is capable of small-diameter extrusion and can be stored for periods of time, thus permits a truly industrial scale manufacture of small-diameter rods of compound pyrotechic products containing a thermosetting binder. This process is highly suitable for the manufacture of compound propellent powders.

A detailed description of the use of the invention is given hereinafter.

The invention thus relates to a process for the manufacture of compound pyrotechnic products, and especially compound propellent powders, containing chiefly, on the one hand, of a thermosetting inert binder and, on the other hand, of at least one organic or inorganic energetic charge. The thermosetting inert binder which can be used within the scope of the present invention is a polyurethane binder obtained by reaction of a polyhydroxylated propolymer with a diisocyante. The polyhydroxylated prepolymer, preferably liquid, has, and this is an essential characteristic of the invention, an average hydroxyl OH group functionality greater than 2 and less than 3, preferably close to 2.3. Such a prepolymer must consist of a mixture of hydroxyetelechelic polyfunctional prepolymers, but the final functionality of the prepolymer must not be obtained by the addition to an essentially difunctional prepolymer of short three- or tetrafunctional polyols of molecular mass which is lower than 400 such as, for example, trimethylolethane, trimethylolpropane or tetramethylolmethane, in contradistinction to what is frequently practised in the thermosetting polyurethane resin industry. The said polyhydroxylated prepolymer must, furthermore, have a weight-averaged molecular mass of between 2,000 and 5,000 and preferably close to 4,000. The polyhydroxylated prepolymers which are preferred within the scope of the present invention are mixtures consisting essentially of polyhydroxylated polybutadienes.

The said polyurethane binder is obtained by reaction of the said polyhydroxylated prepolymer with a diisocyanate. This is another essential characteristic of the invention, namely that the three-dimensional lattice of the thermosetting polyurethane is obtained by reaction of a polyhydroxylated prepolymer with a functionality greater than 2 with a diisocyanate, excluding any polyisocyanate whose functionality might be greater than 2. The Applicant Company will explain in a later part of the description the fundamental importance of this condition in the implementation of the process according to the invention. The isocyanate which is used can be aliphatic, alicyclic or aromatic diisocyanates usually employed in the manufacture of pyrotechnic compositions which call for a polyurethane binder. Mention can be made of 2,4-toluene diisocyanate, 2,6-toluene diisocyanate, 1-methyl-2,6-cyclohexane diisocyanate, 4,4'-dicyclohexylmethane diisocyanate, isophorone diisocyanate, methylene diisocyanate, 1,6-hexane diisocyanate, 2,2,4-trimethyl-1,6-hexane diisocyanate, 1,3-benzene diisocyanate, 1,4-benzene diisocyanate, 4,4'-diphenyl diisocyanate, 4,4'-diphenylmethane diisocyanate, and 3,3'-dimethoxy-4,4'-diphenyl diisocyanate.

The preferred diisocyanates within the scope of the present invention are chosen from the group consisting of 2,4-toluene diisocyanate, 2,6-toluene diisocyanate, 1-methyl-2,4-cyclohexane diisocyanate, 1-methyl-2,6-cyclohexane diisocyanate, 4,4'-dicyclohexylmethane diisocyanate, isophorone diisocyanate, 1,6-hexane diisocyanate and 2,2,4-trimethyl-1,6-hexane diisocyanate. To obtain pyrotechnic compositions which release very little smoke during their combustion, aliphatic or alicyclic diisocyanates will preferably be chosen from the abovementioned list.

The polyhydroxylated prepolymer and the diisocyanate must have rheological properties which enable them to be used without a solvent. They are preferably liquid.

At least one organic or inorganic energetic charge is mixed with the said polyurethane binder. The charges which can be used as an inorganic energetic charger are those chosen from the group consisting of ammonium nitrate, ammonium perchlorate, alkali metal nitrates, alkalineearth metal nitrates, alkali metal perchlorates and alkalineearth metal perchlorates. As an organic energetic charge it is possible to use the organic nitro compounds which are known as energetic compounds and especially cyclotrimethylenetrinitriamine (hexogen), cyclotetramethylenetetranitramine (octogen), pentaerythritol tetranitrate (pentrite) and triaminoguanidine nitrate.

Within the scope of the present invention, the proportion of the weight of energetic charge relative to the weight of the polyurethane binder is preferably close to 4.

Besides the binder and the charge, the pyrotechnic products according to the invention generally contain the usual additives which are known to the specialist and are specific to the final application for which the said products are intended, such as especially plasticizers, wetting agents, antioxidants, flashreducers, anti-erosion agents, combustion catalysts, and the like.

The process for the manufacture of compound pyrotechnic products according to the invention is furthermore characterized in that the operation is carried out in three distinct steps.

In a first step the said polyhydroxylated polymer is mixed, preferably in a kneader, with the said energetic charge in the presence of the desired additives such as described above and with a quantity of diisocyanate which is between 50% and 90% by weight of the stoichiometric quantity necessary for the complete polymerization of all the hydroxyl OH groups in the said polyhydroxylated prepolymer. After a homogeneous mixture has been obtained, the condensation reaction of the isocyanate NCO groups with the hydroxyl OH groups is carried out so as to obtain a partially polymerized paste. It is during this first step that the functionality conditions specified above when dealing with the polyhydroxylated prepolymer and the isocyanate become important. The Applicant Company has found, in fact, that the polyhydroxylated prepolymers having a hydroxyl OH group functionality of between 2 and 3, obtained by mixing difunctional prepolymers and trifunctional prepolymers, with the exclusion of any short tri- or tetrafunctional polyol, contain statistically two hydroxyl OH groups which are more reactive than the third group used to ensure the residual functionality. By adding, in the first step, a quantity of diisocyanate which represents only 50% to 90% by weight of the total stoichiometric quantity of diisocyanate required for the complete polymerization of all the hydroxyl OH groups in the said prepolymer, the diisocyanate will preferentially react with the two more reactive OH groups in the prepolymer to give an essentially linear polymerization. Thus, at the end of the first step, a partially polymerized paste is obtained which still has some plastic properties and which can be stored for periods of time. This result could not be obtained in the presence of short polyols or of polyisocyanates containing more than 2 NCO groups.

According to a preferred method of implementing the first step, the quantity of diisocyanate which is introduced is between 70% and 80% by weight of the said stoichiometric quantity and the condensation reaction of the isocyanate NCO groups with the hydroxyl OH groups is carried out at a temperature between 50° and 80° C.

In a second step, the partially polymerized paste obtained at the end of the first step is mixed, preferably in a kneader-extruder or in a twin-screw extruder, with the remaining diisocyanate required to attain the said stoichiometric quantity required for completely polymerization of all the hydroxyl OH groups in the said prepolymer, and, after homogenization, the pasty mixture thus obtained is extruded to give the desired geometry. As has already been stated above, one of the major advantages of the process according to the invention lies in the fact that the pasty mixture obtained in this second step, while being of a thermosetting nature, is pseudo-unreactive at ambient temperature or even at a temperature slightly higher than ambient temperature. This pasty mixture can therefore be fabricated without precipitation and without the risk of setting solid irreversibly, so long as the operation is carried out at a temperature below 40° C. in practice. Furthermore, and this is another advantage of the process according to the invention, this pasty mixture simultaneously has still enough plastic properites to be capable of being extruded, even at a small diameter, through dies containing inserts and already enough mechanical strength to retain its shape after extrusion while awaiting the final hot crosslinking which constitutes the third step of the process according to the invention.

In a third step, the condensation reaction of the isocyanate NCO groups added during the second step with the hydroxyl OH groups which are still free in the prepolymer is thus completed by a hot cure. This cure, which is preferably carried out at a temperature between 50° C. and 80° C., enables the three-dimensional crosslinking of the thermosetting binder to be completed and the chemical structure of the pyrotechnic product obtained to be fixed in a definitive manner.

At the end of the third step, the product obtained can undergo the usual finishing treatments required with a view to its final application after it has been converted, if appropriate, into its definitive form by machining or cutting.

The process according to the invention thus makes it possible to obtain compound pyrotechnic products containing a thermosetting binder without the use of solvent and free from the disadvantages presented by the earlier processes using mixtures having a limited pot life.

In particular, the process according to the invention is highly suitable for producing compound propellent powders containing a thermosetting binder for arms, and especially for small-calibre arms. The process according to the invention makes it especially easy to obtain cylindrical compound propellent powders with the conventional single-hole, seven-hole or nineteen-hole geometries which are employed in small- and medium-calibre arms. Within this framework, the preferred powders are the powders obtained by using, as a prepolymer, a polyhydroxylated polybutadiene having an average hydroxyl OH group functionality close to 2.3 and by using hexogen as a charge. Powders which are especially preferred are those obtained by additionally using as a diisocyanate a diisocyanate chosen from the group consisting of aromatic diisocyanate and especially toluene diisocyanate.

However, the process according to the invention can also be applied to the production of compound propellants containing a thermosetting binder or of compound explosives containing a thermosetting binder. The use of the process according to the invention within this framework is particularly advantageous in the cases where the intention is to produce small-diameter extruded compound propellants or compound explosives.

The follwoing examples illustrate, in a non-restrictive manner, some possibilities of implementation of the invention.

EXAMPLE 1

A granular powder with 7-channel cylindrical geometry was manufactured according to the process which is the subject of the present invention.

The powder has the following composition:

| | | |
|---|---|---|
| Binder | hydroxytelechelic polybutadiene | 11.31% by weight |
| | hydroxytelechelic polyether | 0.34% by weight |
| | toluene diisocyanate | 0.94% by weight |
| | dioctyl azeleate | 7.10% by weight |
| | methylenedi(ortho-tert-butyl-para-methylphenol) | 0.12% by weight |
| | lecithin | 0.19% by weight |
| Charge | hexogen (0–100μ) | 80% by weight |

The polybutadiene used has a weight average molecular mass of 4,000 and an average hydroxyl OH group functionality of 2.3, while the polyether used has a weight average molecular mass of 2,000 and an average hydroxyl OH group functionality of 3.

The process used to manufacture the powder is as follows:

First step: Homogenization of the various ingredients of the composition except for the crosslinking agent, under vacuum at 60° C., carried out in a kneader. After two hours' homogenization; addition of a portion of the crosslinking agent so as to obtain a NCO/OH ratio of 0.78. After homogenization, the paste obtained in this manner is precrosslinked in an oven at 60° C. for 5 days.

Second step: The precrosslinkeo passe, cut in a parallelepipedal shape is introduced into the vessel of a kneaderextruder. After kneading for 10 min the remaining crosslinking agent is implemented and then homogenized at 30° C. After 20 min of kneading, the paste is extruded through three dies which are responsible for the final geometry of the powder.

Third step: An oven post-cure is applied to the extruded long rods, for two days at 60° C.

Cutting into particles is then carried out, which enables a directly usable bulk powder to be available.

The characteristics of the powder obtained are as follows:

7-hole cylindrical geometry
D=5.4 mm (particle diameter)
d: 0.6 mm (hole diameter)
web: 0.9 mm
particle length L=8.1 mm
power: 1.06 MJ/kg
flame temperature: 2429 K.
density: 1.59 g/cm$^3$
burning velocity at 100 MPa: 45 mm/s

EXAMPLE 2

Propellent powder rods having the same composition and made according to the same process as in Example 1 were manufactured, with geometries calculated beforehand for ammunition of a medium calibre of 30 mm.

Two geometries were produced:

monotubular cylindrical powder:
D=1.20 mm (particle diameter)
d=0.4 mm (central hole diameter)
web=0.4 mm
L=1.80 mm (particle length)

heptabular cylindrical powder:
D=2.3 mm (particle diameter)
d=0.3 mm (hole diameter)
web=0.35 mm
L=3.45 mm (particle length)

These powders have given the following ballistic results in ammunition using a 245 g shell:

monotubular powder:
powder charge: 51.5 g
maximum pressure in the weapon: 300 MPa (crusher)
initial velocity of the shell: 850 m/s heptatubular powder:
powder charge: 55 g
maximum pressure in weapon: 300 MPs (crusher)
initial velocity of the shell: 890 m/s

EXAMPLE 3

A granular powder having cylindrical geometry with 7 channels was manufactured using the process which is the subject of the present invention.

The composition is the same as in Example 1, except for the nature of the nitramine, hexyogen being replaced by octogen (0–100μ).

The process used is the same as that in Example 1, except in the first step of the process, where the precrosslinking of the binder is effected to give a NCO/OH ratio=0.72. The characteristics of the powder obtained are as follows:

7-hole cylindrical geometry: D: 5.4 mm, d=0.6 mm, web=0.9 mm
particle length: L=8.1 mm
power: 1.064 MJ/kg
flame temperature: 2439 K.
density: 1.61 g/cm$^3$
burning velocity at 100 MPa=45 mm/s

EXAMPLE 4

A granular powder having cylindrical geometry comprising 7 channels was manufactured using the process which is the subject of the present invention.

The powder has the following composition:

| | | |
|---|---|---|
| Binder | hydroxytelechelic = polybutadiene | 11.31% by weight |
| | hydroxytelechelic polyether = | 0.34% by weight |
| | toluene diisocyanate = | 0.94% by weight |
| | dioctyl phthalate = | 3.32% by weight |
| | methylenedi(ortho-tert- = butyl-para-methylphenol) | 0.13% by weight |
| | lecithin = | 0.19% by weight |
| | ferrocene derivative = | 3.77% by weight |

-continued

| | | |
|---|---|---|
| Charge | = hexogen (0–100μ) = | 80% by weight |

The polybutadiene and the polyether are those used in Example 1. The process used for producing this composition is the same as that described in Example 1, except in the first step, where the NCO/OH ratio was equal to 0.75.

A powder having the following characteristics was obtained in this manner:

same geometry as the powder described in Example 1
power = 1.06 MJ/kg
flame temperature: 2429 K.
density = 1.59 g/cm$^3$
burning velocity at 100 MPa = 55 mm/s

EXAMPLE 5

A granular powder with cylindrical geometry comprising 7 channels was manufactured according to the process which is the subject of the present invention.

The powder has the following composition:

| | | |
|---|---|---|
| Binder | hydroxytelechelic = polybutadiene | 11.81% by weight |
| | hydroxytelechelic polyether = | 0.95% by weight |
| | toluene diisocyanate = | 0.95% by weight |
| | dioctyl phthalate = | 5.96% by weight |
| | methylenedi(ortho-tert- = butyl-para-methylphenol) | 0.13% by weight |
| | lecithin = | 0.20% by weight |
| Charge | triaminoguanidine nitrate = | 10% by weight |
| | hexogen (0–100μ) = | 70% by weight |

The polybutadiene and the polyether are those used in Example 1. The process used to produce this composition is the same as that described in Example 1, except in the first step, where the NCO/OH ratio was equal to 0.70.

A powder having the following characteristics was obtained in this manner:

same geometry as the powder described in Example 1
power: 1.024 MJ/kg
flame temperature: 2250 K.
density: 1.51 g/cm$^3$
burning velocity at 100 MPa: 65 mm/s

EXAMPLE 6

A granular powder with cylindrical geometry comprising 7 channels was manufactured according to the process which is the subject of the present invention.

The powder has the following composition:

| | | |
|---|---|---|
| Binder | hydroxytelechelic polyether = | 10.63% by weight |
| | polyethertriol = | 0.32% by weight |
| | isophorone diisocyanate = | 2.05% by weight |
| | dioctyl phthalate = | 6.64% by weight |
| | lecithin = | 0.20% by weight |
| | methylenedi(ortho-tert- = butyl-para-methylphenol) | 0.13% by weight |
| | dibutyltin dilaurate = | 0.03% by weight |
| Charge | = hexogen (0–100μ) = | 80% by weight |

The hydroxytelechelic polyether has a weight average molecular mass of 2,800 and a hydroxyl OH group functionality close to 2, the polyethertriol has a weight average molecular mass of 2,000 and a hydroxyl OH group functionality equal to 3.

The process used to produce this composition is the same as that described in Example 1 except in the first step, where the NCO/OH ratio was equal to 0.69.

A powder having the following characteristics was obtained in this manner:

same geometry as the powder described in Example 1
power: 1.09 MJ/kg
flame temperature: 2500 K.
density: 1.63 g/cm$^3$
burning velocity at 100 MPa: 40 mm/s

EXAMPLE 7

A granular powder with cylindrical geometry comprising 7 channels was manufactured according to the process which is the subject of the present invention.

The powder has the following composition:

| | | |
|---|---|---|
| Binder | hydroxytelechelic polyester | 13.90% by weight |
| | polyetherrtrial | 0.42% by weight |
| | methylenedicyclohexyl diisocyanate | 3.13% by weight |
| | diethyl butyl carbonate | 5.23% by weight |
| | graphite | 0.77% by weight |
| Charge | = octogen (0–100μ) | 76.5% by weight |

The hydroxytelechelic polyester has a number average molecular mass of 3,200 and a hydroxyl OH group functionality equal to 2.4, the polyethertriol is the same as that used in Example 6.

The process used to produce this composition is the same as that described in Example 1 except in the first step, where the NCO/OH ratio is equal to 0.84.

A powder having the following characteristics was obtained in this manner:

same geometry as the powder described in Example 1
power: 1.16 mJ/kg
flame temperature: 2861 K.
density: 1.72 g/cm$^3$
burning velocity at 100 MPa: 38 mm/s

EXAMPLE 8

A granular powder with cylindrical geometry comprising 7 channels was manufactured according to the process which is the subject of the present invention.

The powder has the following composition:

| | | |
|---|---|---|
| Binder | hydroxytelechelic polycarbonate | 12.66% by weight |
| | methylenedicyclohexyl diisocyanate | 4.19% by weight |
| | diethyl butyl carbonate | 5.07% by weight |
| | lecithin | 0.17% by weight |
| | methylened(ortho-tert- butyl-para-methylphenol) | 0.34% by weight |
| | graphite | 0.77% by weight |
| Charge | = octogen (0–100μ) | 76.8% by weight |

The hydroxytelechelic polycarbonate has a weight average molecular mass of 3,000 and a hydroxyl OH group functionality close to 2.7.

The process used to produce this composition is identical in all respects to that described in Example 1.

A powder having the following characteristics was obtained in this manner:

same geometry as the powder described in Example 1
power: 1.17 MJ/kg
flame temperature: 2671 K.
density: 1.67 g/cm$^3$
burning velocity at 100 MPa: 30 mm/s

EXAMPLE 9

Hollow rods consisting of a compound propellant were manufactured to produce charges with a very short burning time according to the process of the present invention.

The propellant has the following composition:

| | | |
|---|---|---|
| Binder | hydroxytelechelic polybutadiene | 11.37 parts weight weight |
| | ferrocene derivative | 5.45 parts by weight |
| | methylenedi(ortho-tert-butyl-para-methylphenol) | 0.176 parts by weight by weight |
| | lecithin | 0.176 parts by weight |
| toluene diisocyanate | | 0.74 |
| Charge | ammonium perchlorate (15μ) | 38 parts by weight |
| | ammonium perchlorate (3μ) | 42 parts by weight |
| | aluminum | 2 parts by weight |

The hydroxytelechelic polybutadiene is the same as that used in Example 1.

The manufacturing process used is the same as that described in Example 1 except in the first step, where the NCO/OH ratio was equal to 0.75.

The rods obtained have the following characteristics:
external diameter: 10.2 mm
central channel diameter: 6 mm
rod length: 137 mm The charge consists of 31 identical rods which are set into an inert sole-plate.

This charge gives the following performances:
pressure: 44 MPa at +20° C.
burning velocity: 106 mm/s
Port to throat area ratio coefficient: 0.56 (according to french definition)
nozzle neck diameter: 43.1 mm
level thrust impulse: 664 Newton second

EXAMPLE 10

Compound explosive cylinders were manufactured according to the process of the present invention.

This explosive has the following composition:
hydroxytelechelic polyester 13.90%
polyetherthiol 0.42%
methylenedicyclhexyl diisocyanate 3.13%
diethyl butyl carbonate 5.23%
graphite 0.77%
iron acetylacetone 0.0005%
octogen (0–100μ) 76.5%

The polyester and the polyether are the same as those used in Example 7. The process used to produce this composition is the same as that described in example 1 except in the first step, where the NCO/OH ratio was equal to 0.84.

The measured characteristics of this product are:
density: 1.67 g/cm$^3$
detonation velocity: 7,915 m/s
mechanical properties at 20° C.
in compression (1 mm/min)
Sm=2.8 MPa (maximum breaking stress)
E=29 MPa (modulus of elasticity)
em=17.3% (maximum crushing before break)
under traction (10 mm/min)
Sm=0.8 Mpa

EXAMPLE 11

A compound explosive with a composition identical to that of the powder mentioned in Example 8 was manufactured and some of its characteristics were determined
density: 1.67 g/cm$^3$
detonation velocity: 8,060 m/s
mechanical properties at 20° C. in compression:
Sm=5.9 MPa
E=55.9 MPa
em=15.6%

We claim:

1. Process for the manufacture of compound pyrotechnic products consisting essentially of, a polyurethane binder obtained by the reaction of a polyhydroxylated prepolymer with a diisocyanate and at least one inorganic or organic energetic charge, wherein said polyhydroxylated prepolymer has a weight average molecular mass between 2,000 and 5,000 and an average hydroxyl OH group functionality greater than 2 and less than 3 and said process being comprised of the steps of (1) mixing said polyhydroxylated prepolymer with said energetic charge and with a quantity of diisocyanate which is between 50% and 90% by weight of the stoichiometric quantity required for complete polymerization of all the hydroxyl OH groups of said prepolymer, such that the condensation reaction of the isocyanate NCO groups with the hydroxyl OH groups produces a partially polymerized paste; (2) mixing said partially polymerized paste with the remainder of the diisocyanate required to attain the said stoichiometric quantity required for complete polymerization, and extruding the resultant paste mixture; and (3) hot curing said pasty mixture so as to complete the condensation reaction of the isocyanate NCO groups added during the second step with the hydroxyl groups of said prepolymer which are still free.

2. Process according to claim 1, wherein said polyhydroxylated prepolymer has an average hydroxyl OH group functionality close to 2.3.

3. Process according to claim 1, wherein said polyhydroxylated prepolymer has a weight average molecular mass close to 4,000.

4. Process according to claim 1, wherein said polyhydroxylated prepolymer is a polyhydroxylated polybutadiene.

5. Process according to claim 1, wherein said diisocyanate is chosen from the group consisting of 2,4-toluene diisocyanate, 2,6-toluene diisocyanate, 1-methyl-2,4-cyclohexane diisocyanate, 1-methyl-2,6-cyclohexane diisocyanate, 4,4'-dicyclohexylmethane diisocyanate, isophorone diisocyanate, methylene diisocyanate, 1,6-hexane diisocyanate and 2,2,4-trimethyl-1,6-hexane diisocyanate.

6. Process according to claim 1, wherein said inorganic energetic charge is chosen from the group consisting of ammonium nitrate, ammonium perchlorate, alkali metal nitrates, alkaline-earth metal nitrates, alkali metal perchlorates and alkaline-earth metal perchlorates.

7. Process according to claim 1, wherein said organic energetic charge is chosen from the group consisting of hexogen, octogen, penthrite and triaminoguanidine nitrate.

8. Process according to claim 1, wherein said proportion of the weight of energetic charge relative to the weight of polyurethane binder is about 4.

9. Process according to claim 1, wherein the quantity of diisocyanate which is added in said first step is between 70% and 80% by weight of said stoichiometric quantity.

10. Process according to claim 1, wherein said first step the condensation reaction of the isocyanate groups with the hydroxyl groups is carried out at a temperature between 50 C. and 80 C.

11. Process according to claim 1, wherein said third step said hot cure is carried out at a temperature between 50 C. and 80 C.

12. Compound propellent powders obtained by the process of claim 1.

13. Process according to claim 12, wherein said polyhydroxylated prepolymer is a polyhydroxylated polybutadiene which has an average hydroxyl OH group functionality close to 2.3 and said energetic charge is hexogen.

14. Powders according to claim 13, wherein said diisocyanate is chosen from the group consisting of aromatic diisocyanates.

15. Compound propellants obtained by the process of claim 1.

16. Compound explosives obtained by the process of claim 1.

* * * * *